United States Patent [19]

Harper

[11] 3,949,263

[45] Apr. 6, 1976

BEST AVAILABLE COPY

[54] DIAMOND BRAZING METHOD FOR SLOW WAVE ENERGY PROPAGATING STRUCTURES

[75] Inventor: Robert Harper, Concord, Mass.

[73] Assignee: Raytheon Company, Lexington, Mass.

[22] Filed: Dec. 20, 1974

[21] Appl. No.: 535,009

[52] U.S. Cl. ..... 315/3.5; 165/185; 29/25.16; 313/42; 315/3.6

[51] Int. Cl.[2] ..... H01J 25/34

[58] Field of Search ..... 315/3.5, 3.6; 313/42; 357/81; 165/185; 29/600, 601, 25.16

[56] References Cited

UNITED STATES PATENTS

| | | | |
|---|---|---|---|
| 3,389,290 | 6/1968 | Yoshida et al. | 313/346 R |
| 3,778,665 | 12/1973 | Harper | 315/3.5 |

OTHER PUBLICATIONS

"Diamond as an Insulating Heat Sink for a Series Combination of Impatt Diodes," Proc. IEEE, Apr. 1968.

"Embedded Diamond Heat Sinks for Avalanche Diodes," by Russel et al., Proc. IEEE, Aug. 1972, Vol. 60, No. 8.

*Primary Examiner*—Saxfield Chatmon, Jr.
*Attorney, Agent, or Firm*—Edgar O. Rost; Joseph D. Pannone; Herbert W. Arnold

[57] ABSTRACT

Diamond heat sink members are now employed to conduct thermal energy from slow wave structures in traveling wave type interaction devices to permit operation at high power levels. The diamond members are bonded to adjacent desired components by a method including heating an intermediate metal alloy of an inactive conductive metal and a small amount of a carbide constituent in a vacuum and the application of pressure. A critical temperature slightly above the melting point of the alloy of between 1000° C and 1100° C is required to wet and bond the alloy material to the diamond and any desired surface.

6 Claims, 4 Drawing Figures

FIG. 4
PRIOR ART
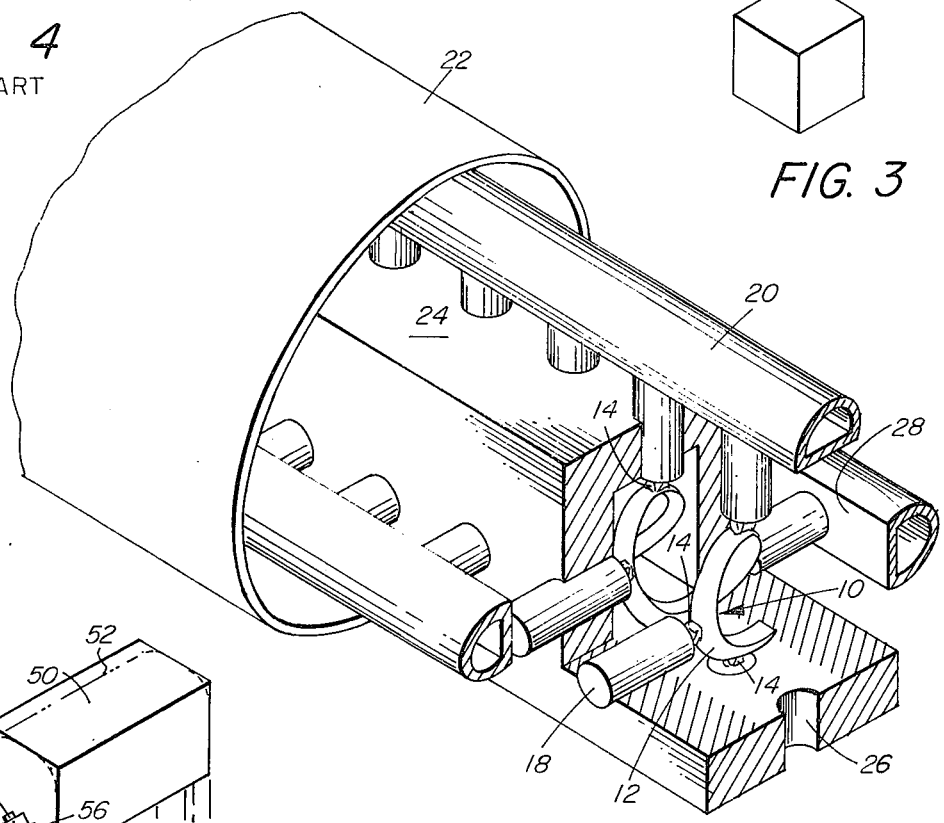
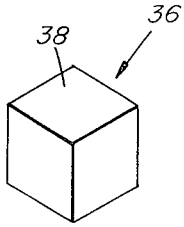
FIG. 3
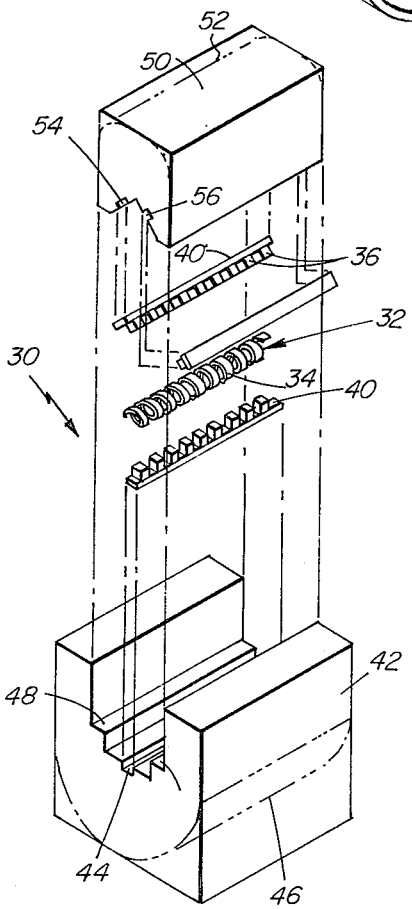
FIG 1
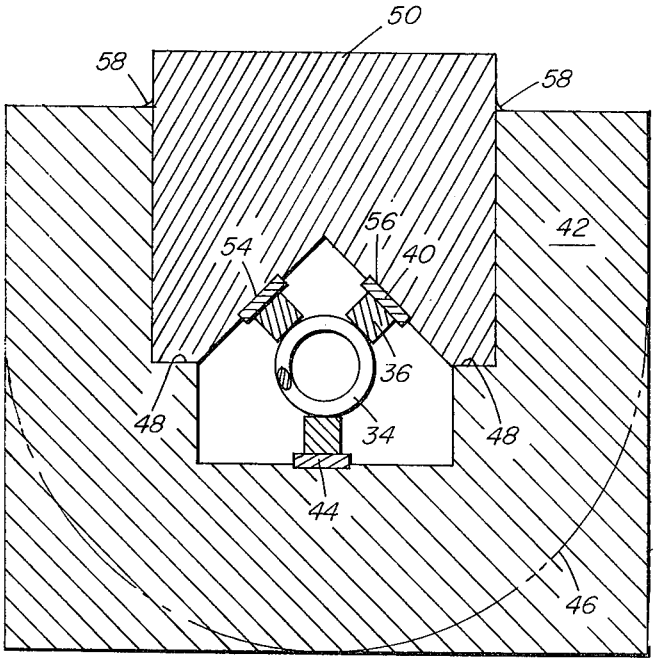
FIG. 2

DIAMOND BRAZING METHOD FOR SLOW WAVE ENERGY PROPAGATING STRUCTURES

BACKGROUND OF THE INVENTION

1. Field of the Invention

The invention relates a method of bonding diamond heat sinks to adjacent structures to support slow wave electromagnetic energy propagating structures.

2. Description of the Prior Art

Traveling wave electron discharge devices typically incorporate a slow wave electromagnetic energy propagating circuit comprising a plurality of spaced periodic metallic members. The helix exemplifies one such a structure for propagating and amplifying electromagnetic energy by extracting kinetic energy from an adjacent high power electron beam. The high frequency energy travels along the slow wave structure at a velocity less than that of light and a synchronous relationship is established to provide for interaction between the electrons in the beam and the waves on the slow wave structure. Electric and magnetic fields of the traveling electromagnetic energy induce perturbations in the electron beam to form electron packets or bunches and space charge waves as a result of the net exchange of energy. The electron beam becomes velocity and density modulated along the direction of trajectory to produce alternating high frequency energy in either the backward or forward wave mode. The slow wave structure due to ohmic losses as well as electron bombardment becomes heated and a considerable amount of thermal energy must be dissipated from such structures. Such thermal energy dissipation is required in order to attain higher average power levels in the electron interaction devices. This requirement is most significant at higher microwave energy frequencies where the physical dimensions of the slow wave guiding structure are relatively small which results in an overall increase in the thermal impedances. Typically, prior art devices utilize slow wave structure supports of nonelectrically conductive materials such as beryllia, boron nitride or ceramic having high thermal conductivity characteristics. Such materials are conventionally provided as elongated rods contacting the periodic components and extending parallel to the longitudinal axis of the device.

In accordance with U.S. Pat. No. 3,778,665 issued to R. Harper et al Dec. 11, 1973 and assigned to the assignee of the present invention, a means for reduction of the thermal impedances and increasing the thermal energy dissipation properties is disclosed utilizing spaced diamond heat sink support structures individually contacting the slow wave helix turns. The dielectric constant of diamonds is approximately 5.58 which is lower than beryllia and, therefore, low dielectric loading of the overall structure is attained together with the high thermal conductivity. The thermal conductivity of several types of natural diamonds are in the range of from 9 watts/°C/cm to about 26 watts/°C/cm. In the embodiment shown in the referenced patent diamond heat sink support structures are bonded or supported under compression at one end between metallic support rods and the inner walls of the envelope of the device. The other end contacts the turns of the helix slow wave structure. Further thermal energy dissipation means include the circulation of a fluid coolant adjacent the metallic supports for the diamond heat sink members. In an exemplary embodiment of the diamond supported helix slow wave structure shown in the referenced patent, and FIG. 4 of the drawings, the diamond heat sink supports provided approximately a sevenfold increase in thermal energy dissipation characteristics over prior art structures.

In FIG. 4 the prior art slow wave energy propagating structure comprises a helix delay line 10 having a plurality of turns 12. A conventional traveling tube device is provided with an electron gun including an emissive cathode adjacent to one end of the slow wave structure, as well as external magnetic field producing means and a collector electrode, together with the coaxial transmission line input and output means. These components have not been illustrated since they are believed to be well known in the art. A plurality of diamond heat sink supports 14 having a substantially flat planar surface 16, as illustrated in FIG. 3, contact turns 12 at spaced intervals approximately 90° apart. Commercial grades of gem quality natural diamonds have thermal conductivity properties varying from 10 to 30 watts/°C/cm. Each of the diamonds is joined by metallurgical techniques to rod members 18. The rod members in turn abut the outer ends of elongated hollow conduit members 20 such as blowpipes which in turn abut the metallic envelope 22. The referenced components are maintained within the tube envelope by means of a backwall member 24 of a highly conductive metal such as copper provided with spaced holes 26 to accommodate and radially support the rod members 18. Each of the blowpipe conduits 20 may be provided with a substantially flat planar surface 28 to abut against the rod members 18.

The prior art teachings required the metallizing of the diamond support members by a coating of sputtered titanium followed by sputtered platinum and then by a plating of gold. The rod members to which the diamond heat sinks are joined are also gold plated. It is also possible to braze the components with silver-copper eutectic alloy with 12 percent titanium by weight. These metallizing procedures are lengthy and expensive, however, since the end results are of such magnitude, the costs have been borne up to the present time.

It is an object of the present invention to provide a new and improved method for the bonding of diamond heat sink insulator supports for a slow wave structure.

SUMMARY OF THE INVENTION

In accordance with the teachings of the invention a method of brazing diamond heat sink supports for a slow wave structure comprises bonding with a metal alloy in a vacuum with pressure applied to the components. The preferred alloy comprises a predominantly inactive good heat conducting metal selected from copper, silver or gold and a small amount of an active carbide-forming constituent, such as titanium, zirconium or niobium. The alloy material is heated to a critical temperature at or slightly above the melting point in the range of approximately 1000° C to 1,100° C. The brazing alloy flows and bonds to the diamond material to form a diffusion bond having excellent adherence characteristics. A copper zirconium alloy, available under the tradename Amzirc, was utilized in the practice of the invention.

In an exemplary embodiment a plurality of diamond supports having a substantially cubical configuration are first brazed to metal strips of a copper zirconium alloy by heating in a vacuum under pressure to form a diffusion bond at the interface of the diamond material and the metal strips. Alternatively, the support strips may be made of a refractory metal, such as tungsten or molybdenum, and a braze is then made to diamond supports utilizing an intermediate thin strip of the copper zirconium alloy.

When heated in a vacuum at or slightly above the melting point of 1000° C the alloy melts and forms a diffusion bond with the diamond. Further, after heating at this high temperature the alloy remains ductile to compensate for any expansion mismatch.

After the formation of the bond between the strip and diamond supports, a plurality of such strips are assembled within slots in a shell assembly with the inner end of the diamond supports contacting the turns of the helix slow wave structure. The shell assembly halves are compressed and welded to complete the slow wave structure assembly. The helix may be plated with a material such as copper and the compression forces exerted upon the diamond supports will provide for the imbedding into the plating of the diamond supports. Alternatively, an interface member, such as a strip of the copper zirconium alloy, is disposed between the inner ends of the diamond supports and the helix turns, and a second high temperature brazing step would follow.

After completion of the slow wave structure assembly the remaining components of the traveling wave type interaction action device such as the cathode gun, collector electrode and input and output coupling means are assembled within an envelope which is then evacuated.

BRIEF DESCRIPTION OF THE DRAWINGS

Details of the invention will be readily understood after consideration of the following description of an illustrative embodiment and reference to the accompanying drawings, wherein:

FIG. 1 is an exploded isometric view of a helix slow wave structure embodying the invention;

FIG. 2 is a cross-sectional view of the slow wave structure assembly shown in FIG. 1.

FIG. 3 is an isometric view of a cubical diamond support member; and

FIG. 4 is an isometric view partly in section of a prior art embodiment of a diamond-supported slow wave structure.

DESCRIPTION OF THE PREFERRED EMBODIMENT

Referring to FIGS. 1, 2 and 3 the invention will now be described. The slow wave structure 30 embodying the invention comprises a helix 32 having a plurality of turns 34 of a low expansion high strength material, such as tungsten. A plurality of diamond support members 36 of the least expensive commercial grade of natural diamond having a cubical configuration to define planar sufaces 38, as shown in FIG. 3, are utilized to support the helix 32.

An elongated strip 40 is fabricated of the copper zirconium alloy referred to as Amzirc, which is predominately copper with a small amount of approximately 0.15percent zirconium. The active zirconium forms a carbide with the diamond material. Any equivalent brazing alloys, such as gold or silver and a carbide-forming constituent such as titanium or niobium may also be employed. The diamond supports 36 are spaced along the strip 40 as shown in FIG. 1 and the assembly is heated in a vacuum furnace with a pressure applied to the contacting components. A diffusion bond occurs between the alloy material and the diamonds at slightly above the melting point of the alloy or in excess of 1000° C. For the purposes of supporting the helix 32 shown in FIG. 1 three subassemblies of the diamond supports are shown.

A lower body shell half member 42 is provided with a slot 44 adapted to receive the metal alloy strip 40 to which the diamond supports have been diffusion bonded. Shell member 42 may be rectangular as shown or provided with a circular configuration indicated by the dashed line 46 which makes the shell assembly more readily inserted within a cylindrical envelope to complete the overall traveling wave electron discharge device assembly. Body shell member 42 is also provided with shoulders 48 adapted to mate with opposing flat surfaces in the upper half of the body shell half member 50 when all of the components are assembled. It is desirable to have the dimensions of the upper and lower body shell halves dimensioned to compress the diamond support members 36 against the helix turns 34 in the final assembly. The upper shell half 50 is shown having a cubical configuration, however a cylindrical outer wall may also be provided as indicated by the dashed lines 52. The member 50 is provided with two slots 54 and 56 to also receive and position remaining support strips 40 in contact with the helix turns 34. After assembly of the body shell halves, as shown in FIG. 2, the components are welded and brazed as indicated at 58 to complete the slow wave structure assembly. This assembly may then be inserted within the envelope 22 which is shown as cylindrical in FIG. 4. As previously indicated the removal of the corner walls of members 42 and 50 will provide a cylindrical outer wall configuration to permit easy insertion of the slow wave structure assembly within the envelope.

In the disclosed embodiment the diamond supports 36 are compressed against the tungsten helix turns 34 in the final assembly. It is also within the purview of the invention to provide a strip of the brazing alloy between the inner ends of the diamond supports 36 and the helix turns 34 and heating the assembly to slightly above the melting point of the alloy material or approximately 1000° C. Alternatively, the tungsten helix may be copper plated and the compression forces will result in the diamond supports being imbedded into the copper plating to result in an efficient path for the conduction of the thermal energy generated in the helix 32 during operation.

Another method of assembling the diamond supports comprises the provision of metal strips similar to those designated by the numeral 40 of a low expansion high strength refractory metal, such as tungsten or molybdenum. An intermediate strip of the preferred alloy material is then disposed in contiguous relationship between the refractory metal strip and the diamond supports. The heating process step in a vacuum, with the application of pressure, is repeated to result in a brazed joint at a temperature again slightly above the melting point of the alloy material in the range of 1000° C to 1100° C. The utilization of either of the disclosed processing steps will be dependent on such factors as cost and size of components to be bonded.

There is thus disclosed a novel method for bonding diamond heat support members for supporting slow wave structures in electromagnetic energy devices or in any other devices employing diamonds as a heat sink with adjacent components capable of high temperature heating. The active copper zirconium alloy material or the equivalent is heated in a vacuum to a temperature slightly above the melting point of the alloy material while applying a pressure to the components to be bonded. The metal alloy may also be used to wet and bold to ceramics and the like and boron nitride. Numerous modifications, variations and alterations will be evident to those skilled in the art. The foregoing detailed description of a preferred embodiment is, therefore, to be considered in its broadest aspects and not in a limiting sense.

I claim:

1. A slow wave electromagnetic energy propagating structure for traveling wave devices comprising:

a plurality of interconnected periodically spaced elements;

means for positioning said elements within an envelope and dissipating thermal energy including diamond heat sink members;

said diamond members having one surface contacting said spaced elements and being thermally bonded by a metal alloy interface to a noncontacting surface and a support member;

said metal alloy interface comprising predominately an inactive metal selected from group including copper, silver or gold and a carbide forming metal including titanium, zirconium or niobium and being heated to a temperature at or above its melting point.

2. The structure according to claim 1 wherein said metal alloy interface comprises copper and approximately an average of 0.15 percent zirconium and said melting point is in the range of approximately 1000° C – 1100° C.

3. The structure according to claim 1 wherein said diamond support member comprises a strip of said interface alloy metal supporting a plurality of thermally bonded diamonds.

4. The structure according to claim 1 wherein said diamond support member comprises a strip of a high temperature metal including tungsten or molybdenum and an intermediate strip of said interface alloy metal thermally bonded thereto and to a plurality of diamond members.

5. A method of bonding diamond members to adjacent supporting structures comprising the steps of:

positioning said diamond member in contacting relationship with a member of a metal alloy of predominantly an inactive metal selected from group including copper, silver or gold and a small percentage of a carbide-forming metal selected from the group including titanium, zirconium or niobium;

positioning said contacting members in a vacuum furnace; and heating the members to approximately the melting point temperature of said metal alloy while exerting pressure thereon.

6. The method according to claim 5 wherein said metal alloy comprises predominantly copper and approximately 0.15 percent zirconium and said melting point is in the range of approximately 1000° C to 1100° C.

* * * * *